US009579262B2

(12) United States Patent
Crawford et al.

(10) Patent No.: US 9,579,262 B2
(45) Date of Patent: Feb. 28, 2017

(54) CAP AND BOTTLE

(71) Applicant: COLGATE-PALMOLIVE COMPANY, New York, NY (US)

(72) Inventors: John Crawford, Mahopac, NY (US); Scott Beckerman, Jersey City, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/791,413

(22) Filed: Jul. 4, 2015

(65) Prior Publication Data

US 2017/0000691 A1 Jan. 5, 2017

(51) Int. Cl.
*B65D 41/26* (2006.01)
*A61J 7/00* (2006.01)

(52) U.S. Cl.
CPC ..... *A61J 7/0046* (2013.01)

(58) Field of Classification Search
CPC ..... B65D 1/0246; B65D 41/26; A47F 3/18; A47F 3/20
USPC ..... 215/228, 237, 235, 311, 307; 220/254.3, 220/254.1; 222/556, 494
See application file for complete search history.

(56) References Cited

U.S. PATENT DOCUMENTS 2,076,457 A * 4/1937 Genone ..... B65D 41/26 141/381
3,381,838 A * 5/1968 McClain ..... B65D 41/26 215/200
4,660,746 A 4/1987 Wright
4,693,410 A * 9/1987 Selz ..... A47G 19/2205 215/228
5,261,569 A 11/1993 Sandwell
5,330,081 A 7/1994 Davenport
5,361,918 A * 11/1994 Mason ..... A61J 1/20 215/11.1
5,392,947 A 2/1995 Gentile
5,944,207 A * 8/1999 Reidenbach ..... B65D 41/0471 215/237
6,904,867 B2 * 6/2005 Zamjahn ..... G09F 11/23 116/308
6,923,344 B1 8/2005 Chien
8,579,164 B1 11/2013 Sanguinet
2004/0173561 A1 * 9/2004 Wolfe ..... B65D 50/046 215/209

(Continued)

FOREIGN PATENT DOCUMENTS

JP S59-16860 U 2/1984
JP S60-38244 U 3/1985

(Continued)

OTHER PUBLICATIONS

International Search Report and Written Opinion for related PCT/US2016/040383, mailed Oct. 5, 2016.

*Primary Examiner* — King M Chu

(57) ABSTRACT

A bottle for dispensing oral care fluid is provided. The bottle can include a body portion comprising a mouth, side surfaces, and a bottom surface arranged to hold a volume of oral care fluid; and a cap arranged to be secured to the mouth, wherein the cap comprises a integral cup sized to hold a portion of the volume of oral care fluid, wherein the integral cup includes an open end that mates with the mouth and a closed end including a flip-top member arranged at a distal end of the cap.

18 Claims, 11 Drawing Sheets

(56) References Cited

U.S. PATENT DOCUMENTS

| | | | | |
|---|---|---|---|---|
| 2008/0110933 | A1* | 5/2008 | Goncalves | B65D 47/0809<br>222/153.05 |
| 2012/0260487 | A1* | 10/2012 | Nichols | B65D 23/106<br>29/456 |
| 2012/0292283 | A1* | 11/2012 | Kornbrust | B65D 41/26<br>215/228 |
| 2014/0224760 | A1* | 8/2014 | Alsewailem | B65D 41/26<br>215/228 |
| 2015/0090738 | A1 | 4/2015 | Caporale | |

FOREIGN PATENT DOCUMENTS

| | | | |
|---|---|---|---|
| JP | H09-309549 | A | 12/1997 |
| JP | 2004-099126 | A | 4/2004 |

* cited by examiner

CAP AND BOTTLE

BACKGROUND

Mouthwash users can be typically classified as those who take their mouthwash directly from the bottle, also called swiggers, and those that use a cup to dispense the mouthwash. Surveys have shown that swiggers represent about 30% of mouthwash users. Conventional mouthwash bottles, which include a threaded cap that also serves as the cup, are not well designed for swiggers, who do not need a cup. An improved mouthwash bottle could provide a better user experience for both swiggers and non-swiggers alike.

BRIEF SUMMARY

In accordance with aspects consistent with the present disclosure, a bottle for dispensing oral care fluid is provided. The bottle can comprise a body portion comprising a mouth, side surfaces, and a bottom surface arranged to hold a volume of oral care fluid; and a cap arranged to be secured to the mouth, wherein the cap comprises a integral cup sized to hold a portion of the volume of oral care fluid, wherein the integral cup comprises an open end that mates with the mouth and a closed end comprising a flip-top member arranged at a distal end of the cap.

In some aspects, the cap can be secured to an outside surface of the mouth in a friction fit manner.

In some aspects, the cap can be secured to an outside surface of the mouth using a threaded configuration.

In some aspects, the cap and the fliptop member are part of a single mold.

In some aspects, the bottle can further comprise a silicon valve positioned within the mouth.

In accordance with aspects consistent with the present disclosure, a bottle for dispensing oral care fluid is provided. The bottle can comprise a body portion comprising a mouth, side surfaces, and a bottom surface arranged to hold a volume of oral care fluid; a flip-top cap arranged to secure the mouth; and a cup arranged to be secured to the flip-top cap in a first orientation and a second inverted orientation, wherein, in the first orientation, the cup is positioned where an open end of the cup is in a downward position and covers the flip-top cap and, in the second orientation the cup is positioned where the open end is in a upward position.

In some aspects, in the first orientation an inside surface of a closed end of the cup is secured to the flip-top cap and in the second orientation an outside surface of the closed end of the cup is secured to the flip-top cap.

In some aspects, the bottle can further comprise a silicon valve positioned within the top opening.

In accordance with aspects consistent with the present disclosure, a bottle for dispensing a fluid is provided. The bottle can comprise a body portion comprising a mouth, side surfaces, and a bottom surface arranged to hold a volume of fluid; and a cap arranged to be secured to the mouth, wherein the cap comprises a integral cup, wherein the integral cup comprises an open end that mates with the mouth and a closed end comprising a flip-top member arranged at a distal end of the cap, wherein the cap is sized to hold a portion of the volume of the fluid when removed from the bottle. The cap can be secured to an outside surface of the mouth in a friction fit manner. The cap can be secured to an outside surface of the mouth using a threaded configuration. The cap and the flip-top member can be part of a single mold. The bottle can further comprise a valve positioned within the cap to control dispensing of the fluid from the bottle. The valve can be composed of silicon. The valve can open when pressure is applied to the body portion.

In accordance with aspects consistent with the present disclosure, a cap for securing to a mouth of a bottle for dispensing an oral care fluid is provided. The cap can comprise a integral cup, wherein the integral cup comprises an open end that mates with a mouth of the bottle and a closed end comprising a flip-top member arranged at a distal end of the cap, wherein the cap is sized to hold a portion of the volume of the oral care fluid when removed from the bottle. The cap can be secured to an outside surface of the mouth in a friction fit manner. The cap can be secured to an outside surface of the mouth using a threaded configuration. The cap and the flip-top member can be part of a single mold. The cap can further comprise a valve positioned within the cap to control dispensing of the oral care fluid from the bottle to provide a measured amount or dose of oral care fluid when the bottle is squeezed. The valve can be composed of silicon or of similar material. The valve can open when pressure is applied to the body portion. The bottle can comprise a body portion comprising the mouth, side surfaces, and a bottom surface arranged to hold a volume of oral care fluid.

In accordance with aspects consistent with the present disclosure, a cap for securing to a bottle for dispensing oral care fluid is provided. The cap can comprise a flip-top cap arranged to secure a mouth of the bottle; and a cup arranged to be secured to the flip-top cap in a first orientation and a second inverted orientation, wherein, in the first orientation, the cup is positioned where an open end of the cup is in a downward position and covers the flip-top cap and, in the second orientation the cup is positioned where the open end is in a upward position. The first orientation can be an inside surface of a closed end of the cup is secured to the flip-top cap and in the second orientation an outside surface of the closed end of the cup is secured to the flip-top cap. The cap can further comprise a silicon valve positioned within the cap to control the dispensing of the fluid by a measure amount or dose. The bottle can comprise a body portion comprising the mouth, side surfaces, and a bottom surface arranged to hold a volume of oral care fluid.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1A:
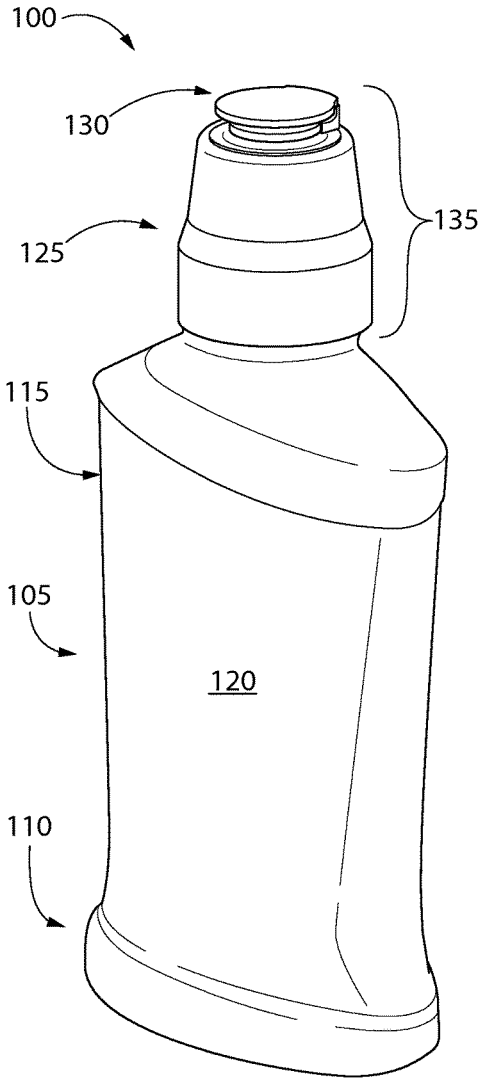
FIGS. 1A and 1B illustrate an example of a front perspective view of a oral care fluid bottle with a cap that includes a flip-top and an integrated cup, showing the flip-top closed and open, respectively, according to the present disclosure.

The following description of the preferred embodiment(s) is merely exemplary in nature and is in no way intended to limit the disclosure, its application, or uses.

The description of illustrative embodiments according to principles of the present disclosure is intended to be read in connection with the accompanying drawings, which are to be considered part of the entire written description. In the description of embodiments of the disclosure disclosed herein, any reference to direction or orientation is merely intended for convenience of description and is not intended in any way to limit the scope of the present disclosure. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the disclosure are illustrated by reference to the preferred embodiments. Accordingly, the disclosure expressly should not be limited to such preferred embodiments illustrating some possible non-limiting combination of features that may exist alone or in other combinations of features; the scope of the disclosure being defined by the claims appended hereto.

Figure 1B:
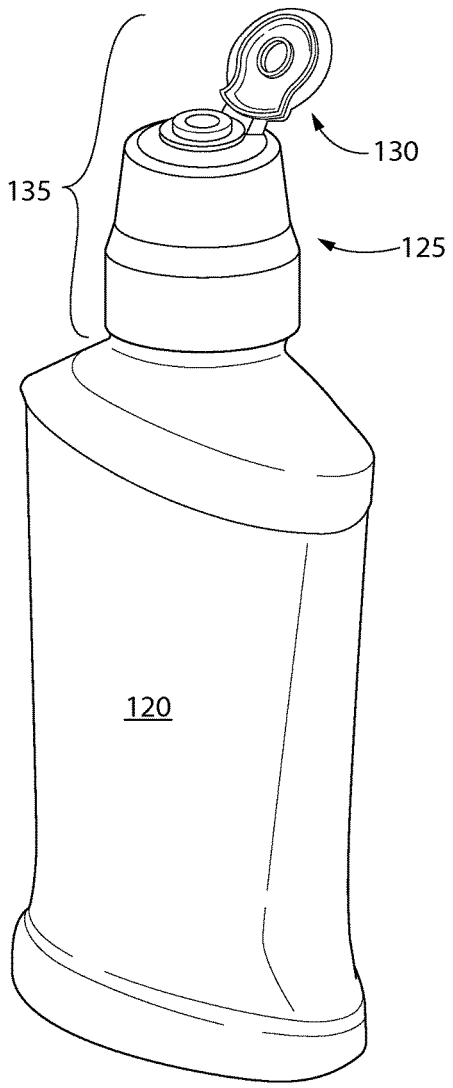

FIGS. 1A and 1B illustrate an example of a front perspective view of a oral care fluid bottle 100 with a cap 135 that includes a fliptop 130 and an integrated cup 125, showing the fliptop 130 closed and open, respectively, according to the present disclosure. The bottle 100 can be conventionally shaped to store and dispense a volume of fluid, such as an oral care fluid (i.e., mouthwash, fluoride solution, teeth whitening solution, etc.) held within. As shown, the bottle 100 can comprise a base 110 that is generally flat and designed to sit stably in an upright position, a body 105 that comprises pairs of sidewalls 115, 120, and a cap 135 in the form of an integrated cup 125 that has a flip-top or flip-top member 130 that opens and closes a hole in the "bottom" of the cup 125, where the bottom is the end opposite the open end of the cup 125. The cup 125 can be integrally molded as a signal piece with the flip-top 130. In the arrangement illustrated in FIGS. 1A and 1B, flip-top 130 is located at a distal end of the cup 125, which is also the distal end of the cap 135. The body 105 of the bottle 100 can be shaped in a substantially rectilinear shape such that the sidewalls 120 have a greater dimension than sidewalls 115. However, the present disclosure is not limited by the shape of the bottle 100. For example, the bottle can be shaped in a substantially cylindrical configuration or some other shape.

Figure 2A:
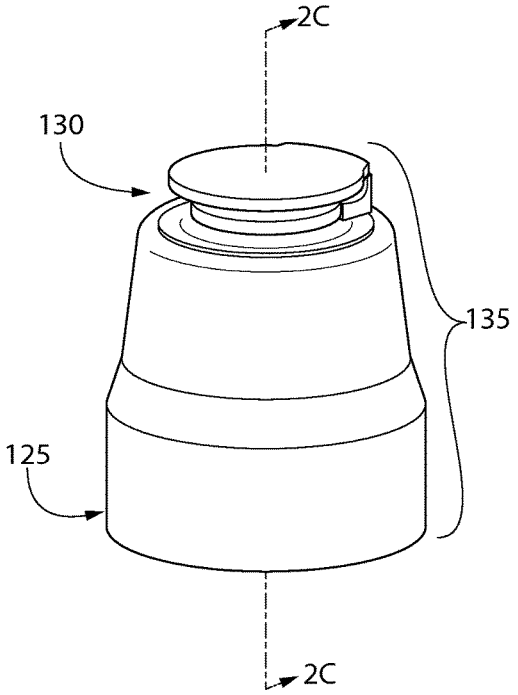
FIGS. 2A-2C illustrate a close up view of the example of a cap that includes a flip-top integrated with a cup of FIGS. 1A and 1B.
Figure 2B:
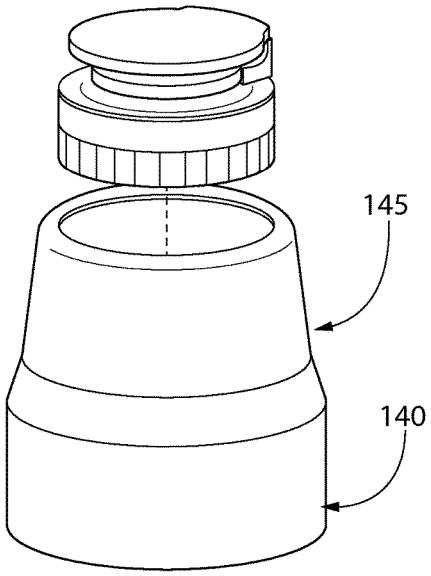
Figure 2C:
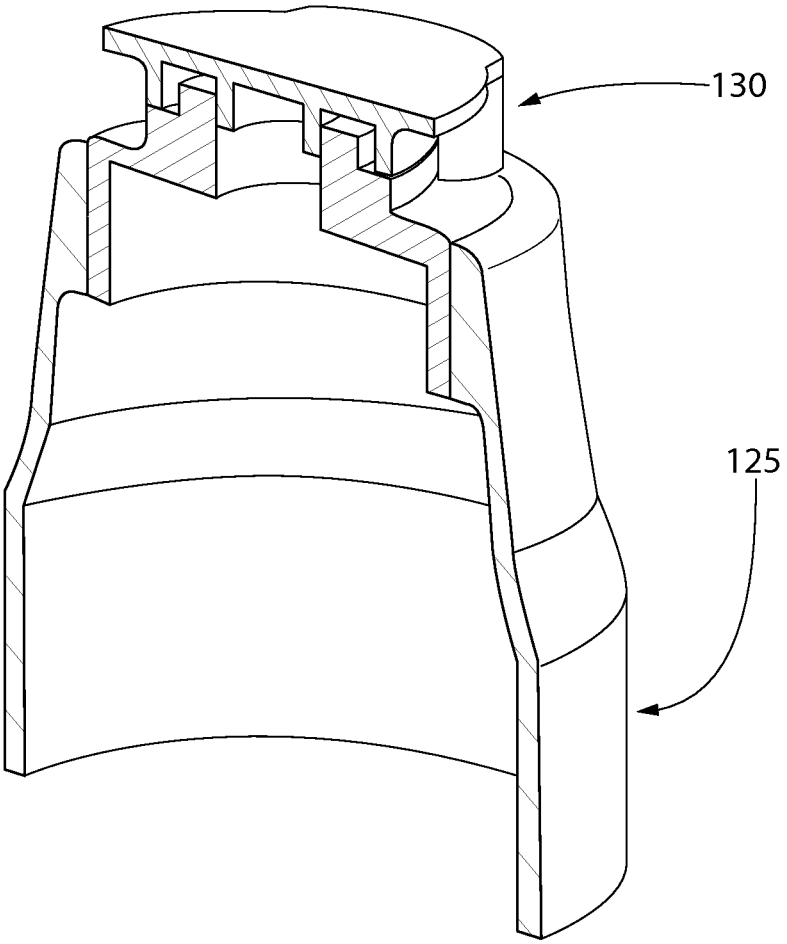

FIGS. 2A-2C illustrate a close up view of the example of a cap 135 that includes a flip-top 130 integrated with a cup 125, as also shown in FIGS. 1A and 1B. In particular, FIG. 2A illustrates an embodiment in which the flip-top 130 and the integrated cup 125 are a single unit that forms the cap 135; the embodiment shown in FIG. 2B illustrates the flip-top 130 and the integrated cup 125 as separate units, which may be joined together to create the cap 135; and FIG. 2C illustrates a cross-sectional view of the cap 135. As best shown in FIG. 2B, in various embodiments, the bottom of the integrated cup 125 may include a skirt 132 that can be attached to body 105 and in particular, be attached to the mouth 150 (FIG. 3A) of the body 105, in a conventional manner, such as by a threaded screw or interference fit arrangement. In addition or alternatively, the integrated cup 125 may have a wide base 140 that can be attached to body 105 and in particular, be attached or secured to the neck 155 (FIG. 3A) of the body 105, in a conventional manner, such as by a threaded screw or interference fit arrangement. In various embodiments, the wide base 140 may tapers to a more narrow portion 145 and ending with the bottom having a hole therein and the flip-top 130.

Figure 3A:
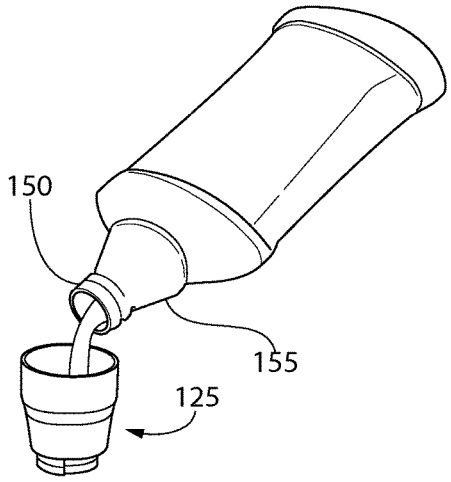
FIG. 3A-3C illustrate examples of use scenarios of the oral care fluid bottle of FIGS. 1A and 1B.
Figure 3B:
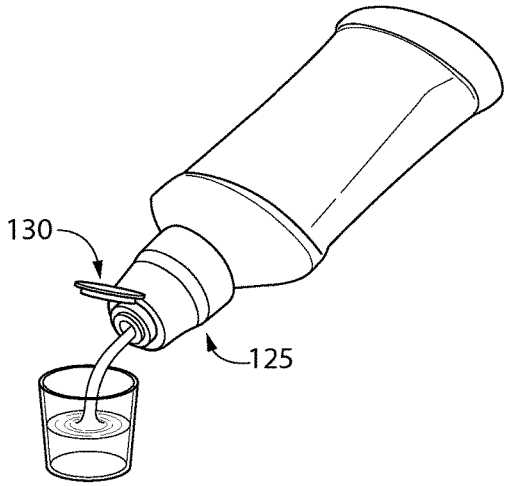
Figure 3C:
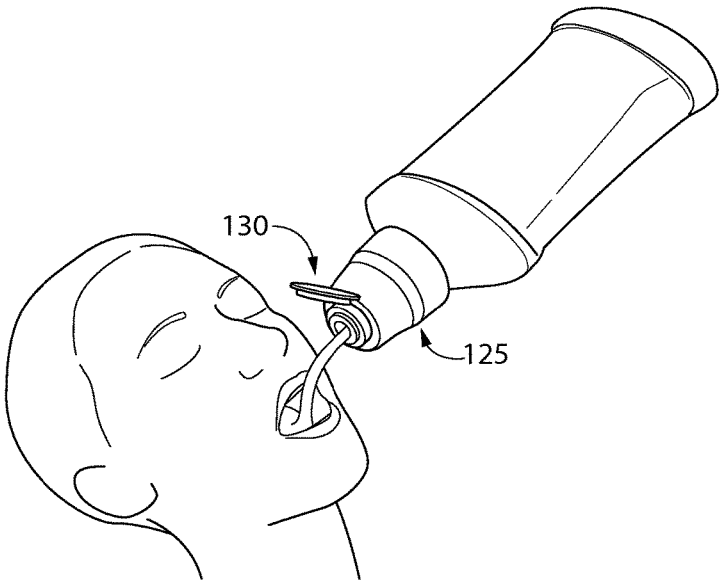

FIG. 3A-3C illustrate examples of use scenarios of the oral care fluid bottle of FIGS. 1A and 1B. The flip-top 130 for the oral care fluid bottle 100 can improve the dispensing experience for either swiggers or for those who pour the oral care fluid into the integrated cup 125 or another cup. The cap 135 can be used in three ways. First, as shown in FIG. 3A, the cap 135 with the integrated cup 125 can be removed from the body 105 and the oral care fluid can be poured into the integrated cup 125, as is done with a conventional oral care fluid cap. Second, as shown in FIG. 3B, the flip-top 130 can be opened while the cap 135 remains on the body 105 and the oral care fluid can be poured through the hole in the bottom of the integrated cup 125 into a separate cup. Third, as shown in FIG. 3C, the flip-top 130 can be opened while the cap 135 remains on the body 105 and the oral care fluid can be poured directly into the mouth. The benefits offered by this arrangement include a better user experience since the flip-top 130 can be opened more quickly and easily than performing the conventional process of unthreading a conventional cap. Another benefit is that the relatively small diameter of the hole in the bottom of the integrated cup 125 compared to the diameter of the mouth 150 of the body 105 provides a smaller and more controlled stream of oral care fluid, which results in less spillage and mess. A further benefit is that as the oral care fluid is dispensed from the bottle 100, contamination and/or degradation of the oral care fluid due to other contaminants or fluids (i.e., saliva) can be minimized or prevented.

Figure 4A:
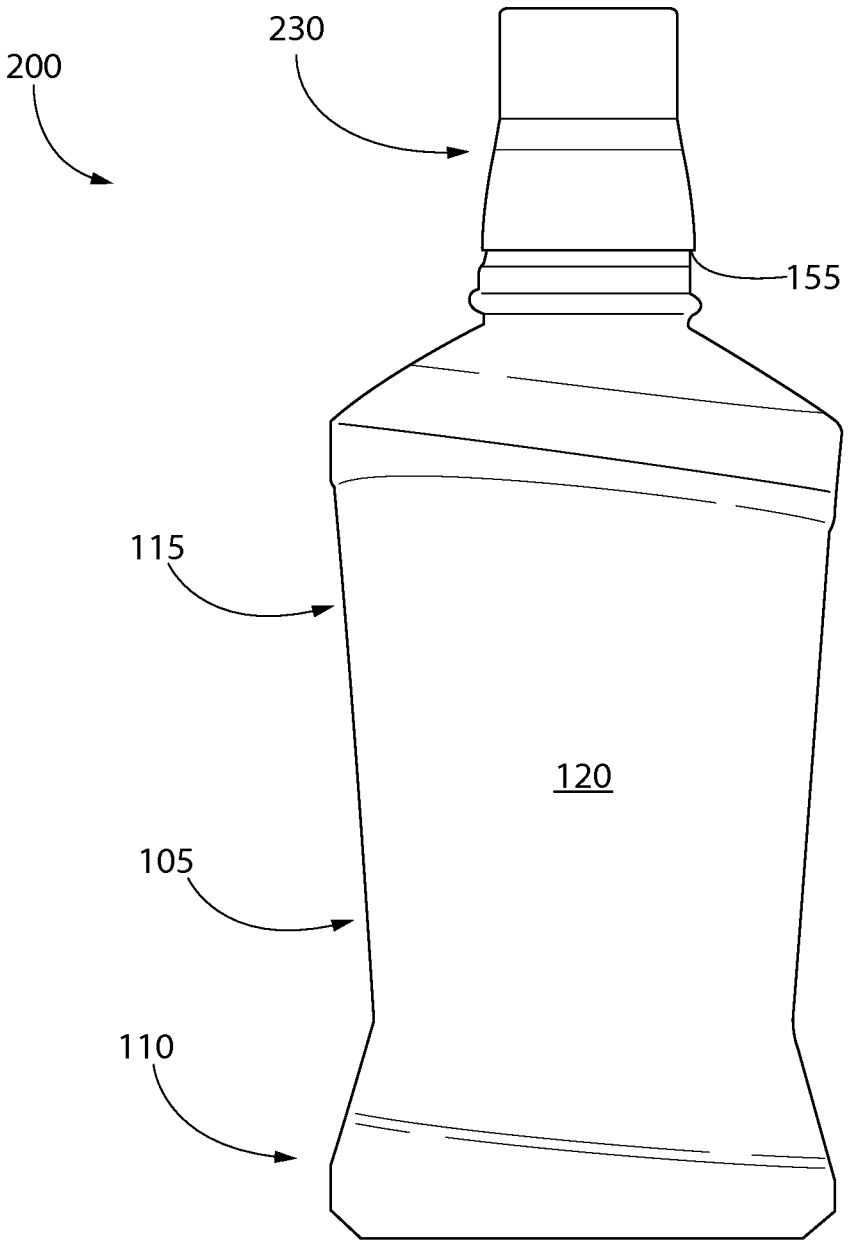
FIG. 4A illustrates a front view of an example of a oral care fluid bottle that includes a separate cup that is attached or nested to a flip-top cap of the oral care fluid bottle in a nesting configuration that is used, for example, when the bottle and cup are on-sale, according to the present disclosure.
Figure 4B:
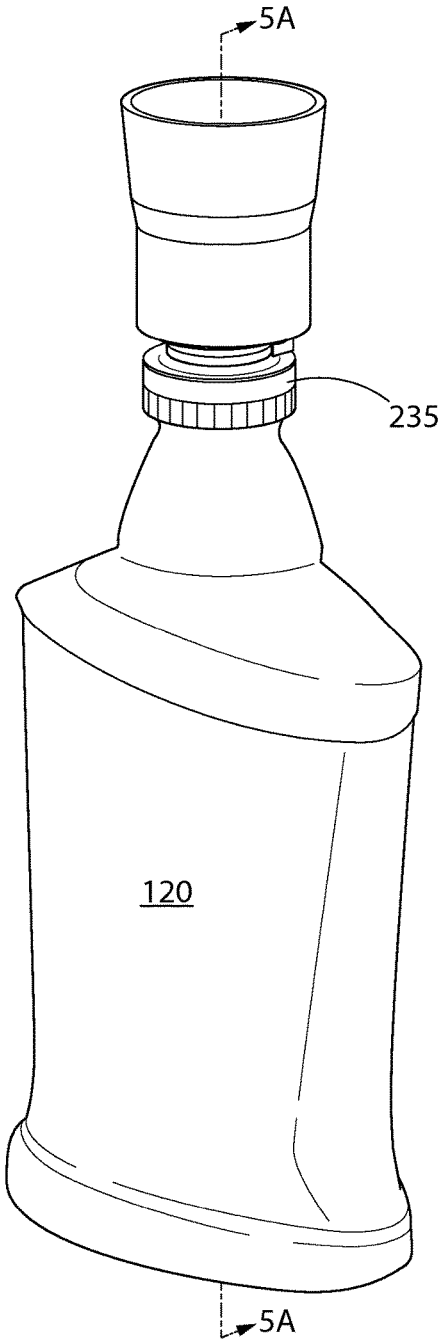
FIG. 4B illustrates a front perspective view of the example of a oral care fluid bottle of FIG. 4A, with the separate cup attached to the flip-top cap in a usage configuration that is used, for example, when the oral care fluid bottle is in use with a consumer after being sold, according to the present disclosure.

FIG. 4A illustrates a front view of an example of a oral care fluid bottle 200 that includes a separate cup 230 that is attached or nested to a flip-top cap 235 of the oral care fluid bottle 200 in a nesting configuration that is used, for example, when the bottle 200 and cup 230 are on-sale, according to the present disclosure. FIG. 4B illustrates a front perspective view of the example of a oral care fluid bottle 200 of FIG. 4A, with the separate cup 230 attached to the flip-top cap 235 in a usage configuration that is used, for example, when the oral care fluid bottle is in use with a consumer after being sold, according to the present disclosure. The bottle 200 can be similar to the bottle 100 and can be conventionally shaped to store and dispense a volume of oral care fluid held within. As shown, the bottle 100 can comprise a base 110 that is generally flat, a body 105 that comprises two pairs of sidewalls 115, 120, and a flip-top cap 235, as best shown in FIG. 6B, and a separate cup 230. The body 105 of the bottle 200 can be shaped in a substantially rectilinear shape such that the sidewalls 120 have a greater dimension than sidewalls 115. However, the present disclosure is not limited by the shape of the bottle 200. For example, the bottle can be shaped in a substantially cylindrical configuration or some other shape. In the "nesting configuration" illustrated in FIG. 4A and in FIG. 6C in close up, the separate cup 230 fits is or secured over the flip-top cap 235 in an interference fit arrangement, such that the cup 230 is attached to the flip-top cap 235 such that the inside surface of the closed end of the cup 230 is secured or fitted to the flip-top cap 235. In the "usage configuration" illustrated in FIG. 4B and in FIGS. 5A and 5B (in close up) and cross section, the separate cup 230 fits on flip-top cap 235 in an inverted arrangement with regard to the nesting configuration. In the usage orientation with the open end 240 of the cup 230 pointing away from the bottle body 105 when the flip-top cap 235 is attached or secured to the body 105, any residual oral care fluid left in the cup 230 after use is prevented from dripping down the side of the body 105 of the bottle 200, in contrast to a conventional cap that functions as a cup.

Figure 5A:
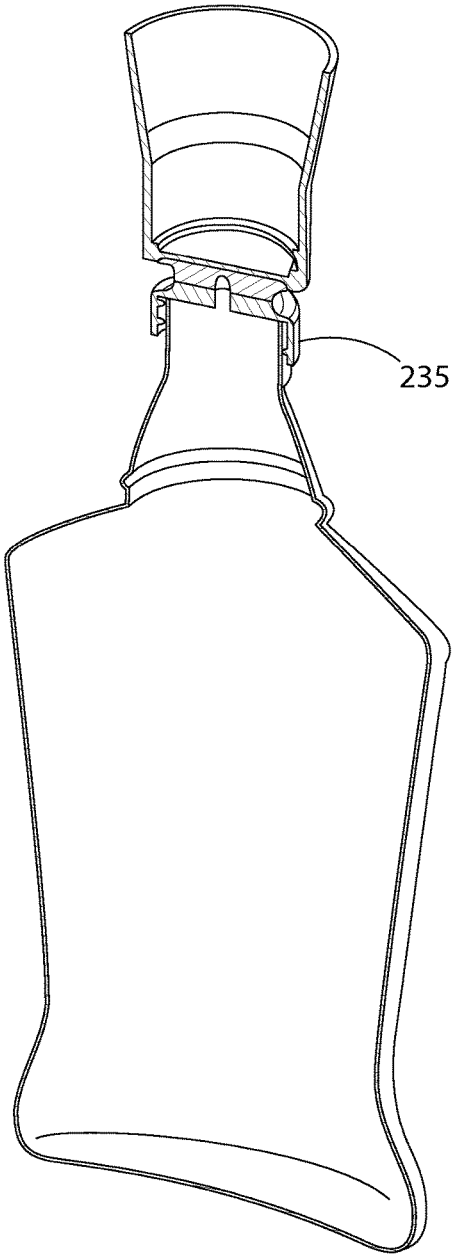
FIGS. 5A and 5B illustrate a cross-sectional view and a close up cross-sectional view of the oral care fluid bottle of FIGS. 4A and 4B with the separate cup attached to the flip-top cap in the usage configuration.
Figure 5B:
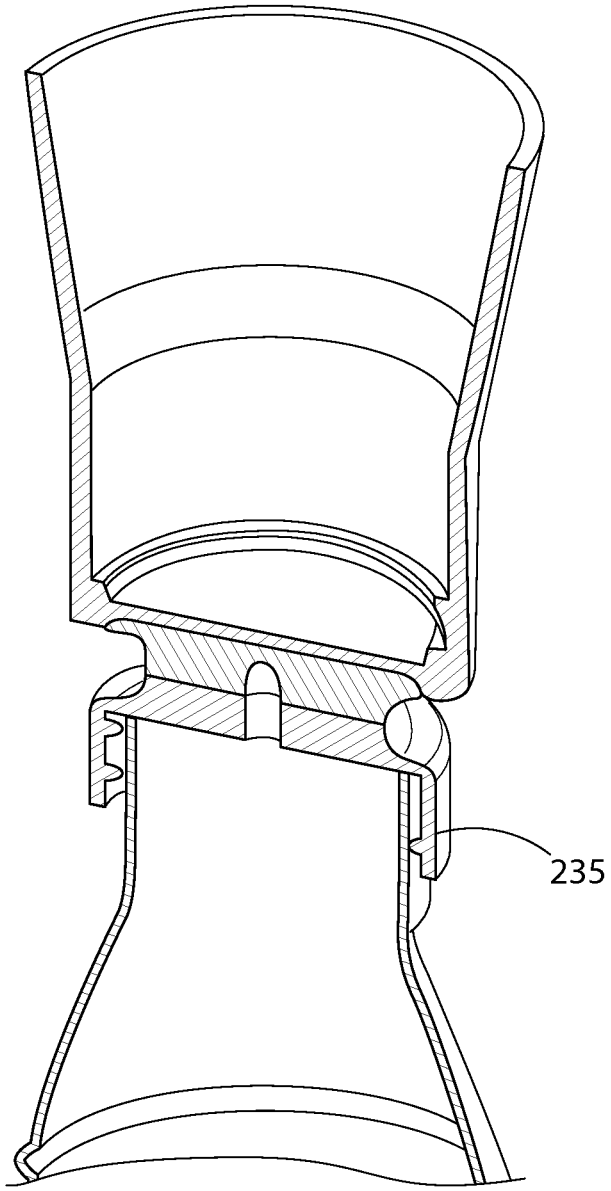

FIGS. 5A and 5B (close-up view of FIG. 5A) illustrate a view, in cross-section, of the bottom of the cup 230 snapping or friction fitting onto the flip-top cap 235 in the usage configuration. In this configuration, the outside surface of the closed end of the cup 230 is secured or fitted to flip-top cap 235.

Figure 6A:
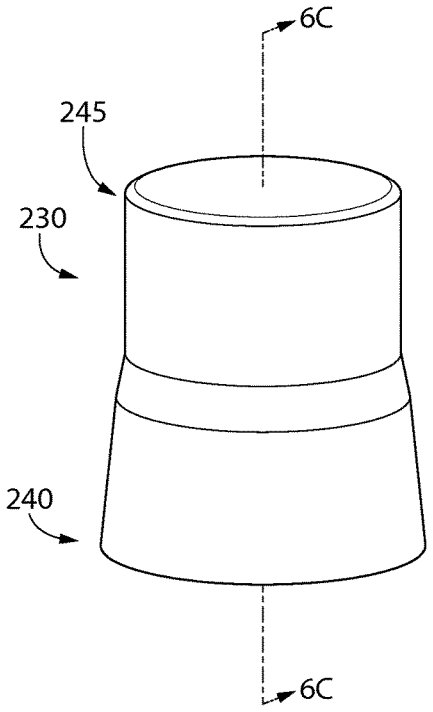
FIGS. 6A-6C illustrate examples of close up views of the flip-top cap with the separate cup, with FIG. 6C illustrating the cup attached to the flip-top cap in the nesting configuration.
Figure 6B:
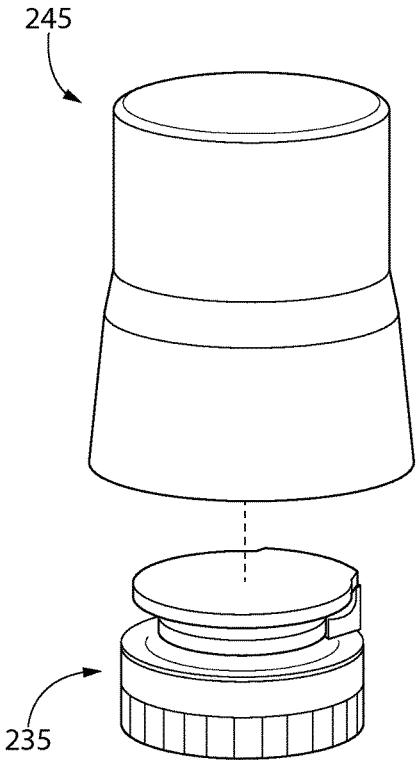
Figure 6C:
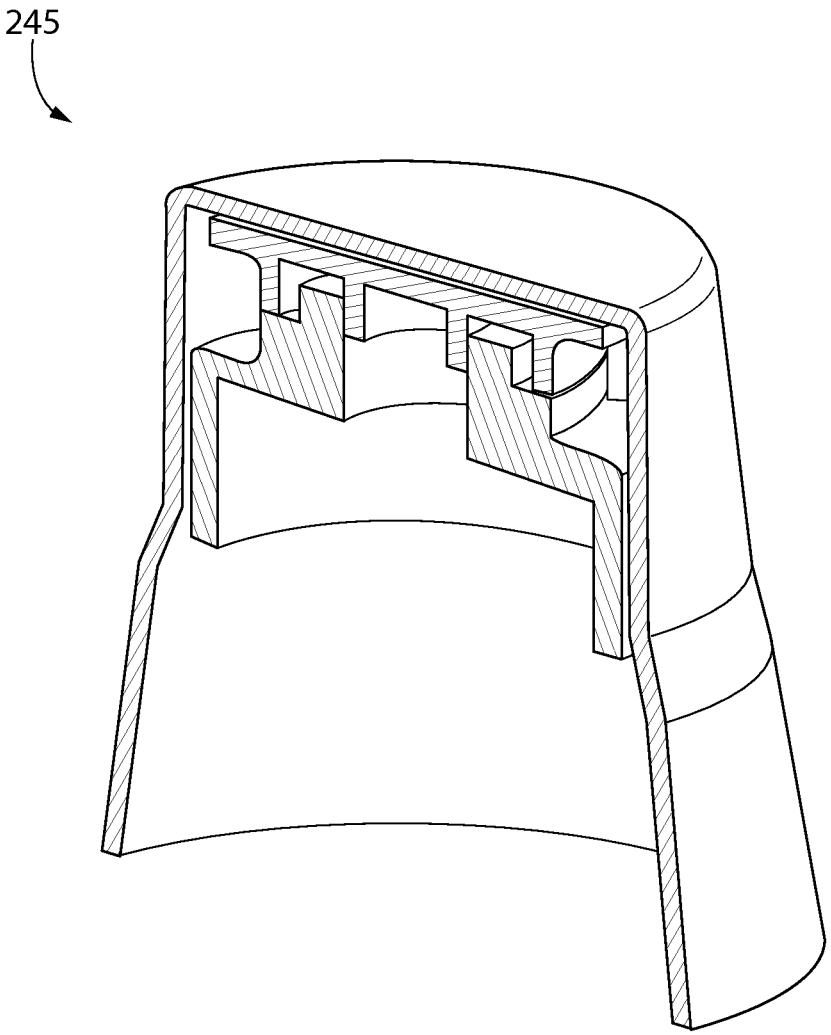

FIGS. 6A-6C illustrate examples of close up views of the flip-top cap 235 and the separate cup 230, with FIG. 6*c* illustrating the cup 230 attached to the flip-top cap 235 in the nesting configuration. In particular, FIG. 6A illustrates the cup 230, oriented for the nesting configuration, having a wider open end 240 tapering to a more narrow closed end 245; FIG. 6B illustrates the flip-top cap 235 and the cup 230 as separate units, which are mutually attachable in two different configurations or orientations; and FIG. 6C illustrates a cross-sectional view of FIG. 6A when the cup 230 and the flip-top cap 235 are attached or arranged in the nesting configuration. In some embodiments, the wider open end 240 can be attached to the body 105 and in particular, be attached to the neck 155 (FIG. 4A) of the body 105, in a conventional manner, such as by a threaded screw or interference fit arrangement. In such embodiments, the attachment of the open end 240 to the neck 155 of the body 105 may be in addition to or as an alternative to an interference fit attachment of the cup 230 to the flip-top cap 235, as shown for example in FIG. 6C.

Figure 7A:
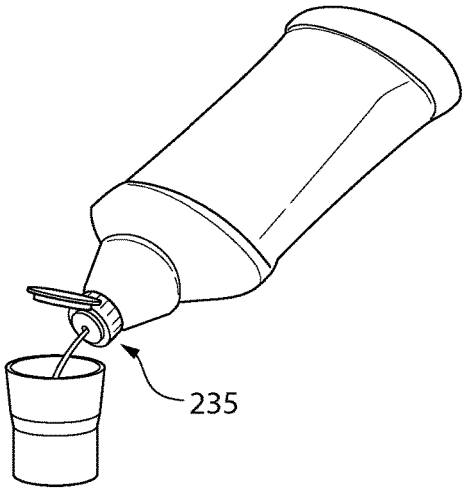
FIG. 7A-7C illustrate examples of use scenarios of the oral care fluid bottle of FIGS. 4A-6C.
Figure 7B:
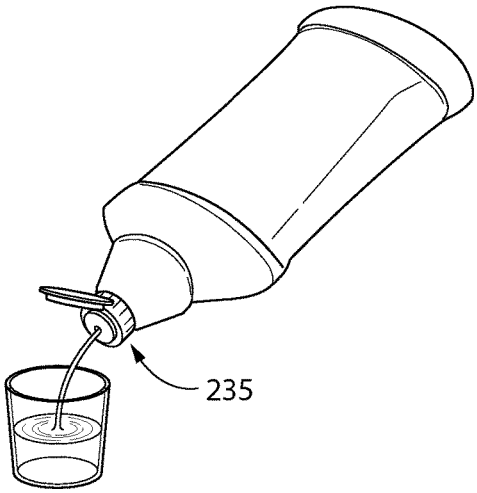
Figure 7C:
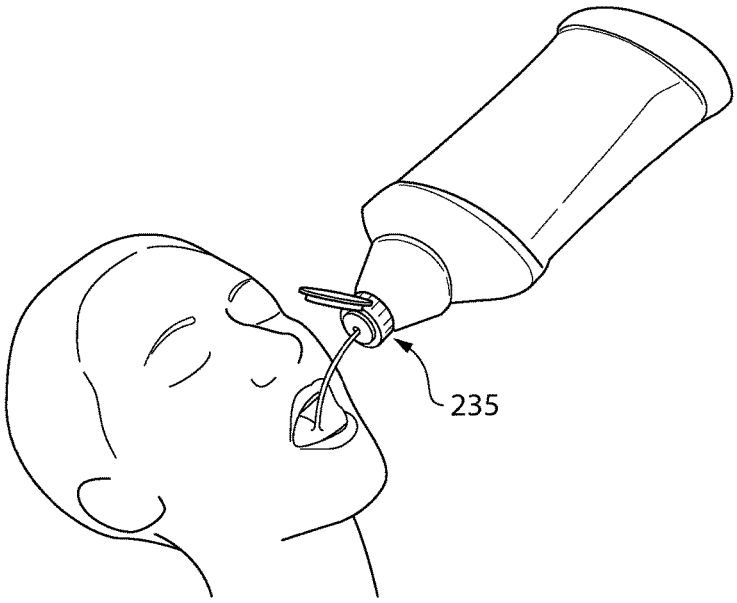

FIG. 7A-7C illustrate examples of use scenarios of the oral care fluid bottle of FIGS. 4A-6C, which can improve the user experience for swiggers, who take their oral care fluid directly from the bottle, and for everyone else who pours the oral care fluid into the cap, or a separate cup. The cup 230 can be used in three ways. First, as illustrated in FIG. 7A, the cup 230 can be separated from the flip-top cap 235, whether starting from the usage configuration (FIG. 4B) or the nesting configuration (FIG. 4A), and then the flip-top cap 235 can be opened, and the oral care fluid pour into the cup 230. Second, as illustrated in FIG. 7B, the flip-top cap 235 can be opened and the oral care fluid poured into a separate cup. Third, as illustrated in FIG. 7C, the flip-top cap 235 can be opened and the oral care fluid poured directly into mouth. The benefits of this arrangement include a better user experience since the flip-top 130 can be opened more quickly and easily than performing the conventional process of unthreading a conventional cap. Another benefit is that the cup 240 can be completely disposed of by users that do not use it (e.g., FIGS. 7B and 7C). Another benefit is that the relatively small diameter of the hole in the flip-top cap 235 compared to the diameter of the mouth of the body 105 provides a smaller and more controlled stream of oral care fluid, which results in less spillage and mess. Yet another benefit is that after use of the cup 240 when it is attached to the flip-top cap 235 in the usage configuration (FIG. 4B), any residual oral care fluid left in the cup 230 after use is prevented from dripping down the side of the body 105 of the bottle 200, in contrast to a conventional cap that functions as a cup. A further benefit is that as the oral care fluid is dispensed from the bottle 100, contamination and/or degradation of the oral care fluid due to other contaminants or fluids (i.e., saliva) can be minimized or prevented.

Figure 8:
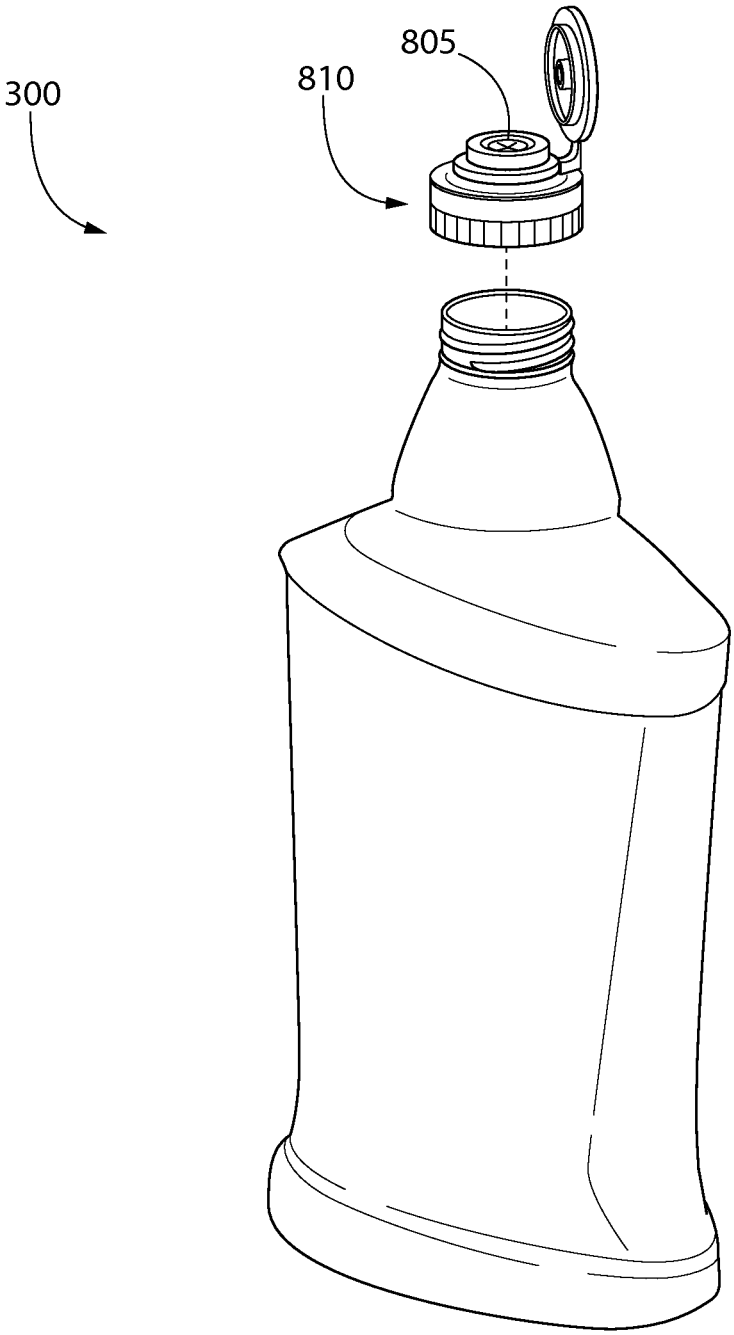
FIG. 8 illustrates an example oral care fluid bottle with a silicon valve, according to the present disclosure.

FIG. 8 illustrates an example oral care fluid bottle 300 with a silicon valve, according to the present disclosure. In some implementations, the bottle 100 and/or bottle 200 can comprise a valve 805 made of silicone or similar material, for example, disposed in the flip-top cap 810 of the bottle 100, 200. The valve 805 can be used to control the dispensing of the oral care fluid from the bottle. For example, the bottle 100, 200, when pressure is applied to the outside surface of the bottle or when squeezed, is able dispense, through the valve 505, a measured or predetermined amount (dose) of oral care fluid.

While the disclosure has been described with respect to specific examples including presently preferred embodiments and modes of carrying out the disclosure, those skilled in the art will appreciate that numerous variations and permutations are possible. It is to be understood that other embodiments may be utilized and structural and functional modifications may be made without departing from the scope of the present disclosure. Thus, the spirit and scope of the disclosure should be construed broadly as set forth in the appended claims.

The devices and apparatuses described herein utilize conventional, commercially-available components which will be readily known to and obtainable by those skilled in the art. Therefore, it is well within ambit of those skilled in the art to assemble such components to create these devices and to employ the methods described herein for the detection and treatment of oral conditions related to the presence of bacteria or bacterial metabolic products without undue experimentation.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the preferred embodiments of the present disclosure, it will be understood that various additions, modifications and substitutions may be made therein without departing from the spirit and scope of the present invention as defined in the accompanying claims. In particular, it will be clear to those skilled in the art that the present disclosure may be embodied in other specific forms, structures, arrangements, proportions, sizes, and with other elements, materials, and components, without departing from the spirit or essential characteristics thereof. One skilled in the art will appreciate that the disclosure may be used with many modifications of structure, arrangement, proportions, sizes, materials, and components and otherwise, used in the practice of the disclosure, which are particularly adapted to specific environments and operative requirements without departing from the principles of the present disclosure. The presently disclosed embodiments are therefore to be considered in all respects as illustrative and not restrictive, the scope of the disclosure being defined by the appended claims, and not limited to the foregoing description or embodiments.

What is claimed is:

1. A bottle for dispensing oral care fluid comprising:

a body portion comprising a mouth, side surfaces, and a bottom surface arranged to hold a volume of oral care fluid; and a cap arranged to be secured to the mouth, wherein the cap comprises an integral cup sized to hold a portion of the volume of oral care fluid, wherein the integral cup comprises an open end that mates with the mouth and a closed end comprising a flip-top member arranged at a distal end of the cap, wherein the closed end comprises a silicon valve that is operable to control dispensing of a measured amount of the oral car fluid from the bottle, wherein the integral cup is stable when the flat flip-top member is positioned on a flat surface so as to prevent tipping over and spilling the oral care fluid contained within the integral cup.

2. The bottle of claim 1, wherein the cap is secured to an outside surface of the mouth in a friction fit manner.

3. The bottle of claim 1, wherein the cap is secured to an outside surface of the mouth using a threaded configuration.

4. The bottle of claim 1, wherein the cap and the flip-top member are part of a single mold.

5. A bottle for dispensing oral care fluid comprising:

a body portion comprising a mouth, side surfaces, a neck that connects the mouth to the side surfaces, and a bottom surface arranged to hold a volume of oral care fluid;

a flip-top cap arranged to secure the mouth; and a cup arranged to be releasably secured to the flip-top cap in a first orientation and a second inverted orientation, wherein, in the first orientation, the cup is positioned where an open end of the cup is in a downward position and covers the flip-top cap and, in the second orientation the cup is positioned where the open end is in a upward position, wherein the cup comprises a closed end opposite the open end that is releasably secured to the flip-top cap, wherein the closed end does not cover the neck when the cup is in the second orientation.

6. The bottle of claim 5, wherein in the first orientation an inside surface of a closed end of the cup is secured to the flip-top cap and in the second orientation an outside surface of the closed end of the cup is secured to the flip-top cap.

7. The bottle of claim 5, further comprising a silicon valve positioned within the cap to control dispensing of a measured amount of the oral care fluid from the bottle.

8. A cap for securing to a mouth of a bottle for dispensing an oral care fluid, the cap comprising:

an integral cup, wherein the integral cup comprises an open end that mates with the mouth of the bottle and a closed end comprising a flip-top member arranged at a distal end of the cap, wherein the closed end comprises a valve that is operable to control dispensing of a measured amount of the oral car fluid from the bottle, wherein the cap is sized to hold a portion of a volume of the oral care fluid when removed from the bottle, wherein the integral cup is stable when the flip-top member is positioned on a flat surface so as to prevent tipping over and spilling the oral care fluid contained within the integral cup.

9. The cap of claim 8, wherein the cap is secured to an outside surface of the mouth in a friction fit manner.

10. The cap of claim 8, wherein the cap is secured to an outside surface of the mouth using a threaded configuration.

11. The cap of claim 8, wherein the cap and the flip-top member are part of a single mold.

12. The cap of claim 8, wherein the valve is composed of silicon.

13. The cap of claim 8, wherein the valve opens when pressure is applied to the bottle.

14. The cap of claim 8, wherein the bottle comprises a body portion comprising the mouth, side surfaces, and a bottom surface arranged to hold a volume of oral care fluid.

15. A cap for securing to a bottle for dispensing oral care fluid, the cap comprising:

a flip-top member arranged to secure a mouth of the bottle; and a cup arranged to be releasably secured to the flip-top member in a first orientation and a second inverted orientation, wherein, in the first orientation, the cup is positioned where an open end of the cup is in a downward position and covers the flip-top member and, in the second orientation the cup is positioned where the open end is in a upward position, wherein the cup comprises a closed end opposite the open end that is releasably secured to the flip-top member, wherein the closed end does not cover a neck of the bottle when the cup is in the second orientation.

16. The cap of claim 15, wherein in the first orientation an inside surface of a closed end of the cup is secured to the flip-top member and in the second orientation an outside surface of the closed end of the cup is secured to the flip-top member.

17. The cap of claim 15, further comprising a silicon valve positioned within the cap.

18. The cap of claim 15, wherein the bottle comprises a body portion comprising the mouth, side surfaces, and a bottom surface arranged to hold a volume of oral care fluid.

* * * * *